US011246800B2

(12) United States Patent
Nguyen et al.

(10) Patent No.: US 11,246,800 B2
(45) Date of Patent: Feb. 15, 2022

(54) LOCKING CANISTER FOR DISPENSING MEDICATIONS

(71) Applicant: Alixa Rx LLC, Plano, TX (US)

(72) Inventors: Huan Nguyen, Lantana, TX (US); Ronald Silva, San Francisco, CA (US); Philip M. Anthony, III, Chicago, IL (US); Evan P. Thompson, Oak Park, IL (US); Trevor K. Wesolowski, Chicago, IL (US)

(73) Assignee: Alixa Rx, LLC, Plano, TX (US)

( * ) Notice: Subject to any disclaimer, the term of this patent is extended or adjusted under 35 U.S.C. 154(b) by 1457 days.

(21) Appl. No.: 13/646,598

(22) Filed: Oct. 5, 2012

(65) Prior Publication Data

US 2014/0097197 A1 Apr. 10, 2014

(51) Int. Cl.
*B65D 83/00* (2006.01)
*A61J 1/03* (2006.01)

(52) U.S. Cl.
CPC ..... *A61J 1/03* (2013.01)

(58) Field of Classification Search
CPC A61J 1/03; B65D 43/22; B65D 55/14; B65D 2251/1058; E05B 57/00; E05B 61/00; E05B 2015/105; E05C 5/00
USPC ..... 221/151, 153, 154, 277, 281
See application file for complete search history.

(56) References Cited

U.S. PATENT DOCUMENTS 3,831,986 A * 8/1974 Kobayashi ..... E05B 47/0038 292/201
3,851,506 A * 12/1974 Simon ..... A24F 15/005 70/271
4,628,389 A * 12/1986 Tanaka ..... G11B 23/08735 242/347.1
5,330,432 A 7/1994 Yoon
5,575,515 A * 11/1996 Iwamoto ..... E05B 47/0002 221/154
5,603,540 A * 2/1997 Shibao ..... E05B 77/06 292/128
6,161,733 A * 12/2000 King ..... A23G 3/0252 222/380

(Continued)

OTHER PUBLICATIONS

PCT International Search Report of International Application No. PCT/US2013/063545 filed on Oct. 4, 2013. 24 Pages.

*Primary Examiner* — Gene O Crawford
*Assistant Examiner* — Kelvin L Randall, Jr.
(74) *Attorney, Agent, or Firm* — Barcelo, Harrison & Walker LLP

(57) ABSTRACT

In certain embodiments, a lockable canister for retaining and selectively dispensing medications is disclosed. To prevent drug diversion, a plurality of doses of medication may be loaded into the locking canister at a central pharmacy and then the canister may be locked to prevent unauthorized removal of medication in transit to a remote automated dispensing unit that may be located in a remote pharmacy. The lockable canister may include a canister housing and a canister cover that may be locked to the canister housing to enclose the plurality of doses of medication. The canister cover may include tamper evident or tamper resistant features. The canister may include one or more locking mechanisms to prevent unauthorized access to the medication in the canister in transit or before it is specifically authorized for dispensing.

34 Claims, 13 Drawing Sheets

(56) References Cited

U.S. PATENT DOCUMENTS 7,186,176 B2 * 3/2007 Umeda ..... G07D 1/00 109/47
7,418,961 B2 9/2008 Jones et al.
7,562,791 B2 * 7/2009 Yuyama ..... G07F 9/002 221/265
8,277,415 B2 10/2012 Mounce et al.
8,744,621 B2 * 6/2014 Michael ..... A47B 88/90 700/242
2002/0096535 A1 * 7/2002 Zhang ..... B65B 35/08 221/258
2003/0105554 A1 * 6/2003 Eggenberger ..... G16H 20/13 700/231
2005/0236849 A1 * 10/2005 Chang ..... E05B 47/023 292/251.5
2006/0058724 A1 * 3/2006 Handfield ..... G07F 9/026 604/20
2006/0175942 A1 * 8/2006 Meek ..... E05B 47/026 312/222
2006/0243738 A1 * 11/2006 Yuyama ..... G07F 11/70 221/281
2007/0262876 A1 * 11/2007 Marsilio ..... E05B 73/0023 340/572.8
2008/0252083 A1 * 10/2008 Carabalona ..... E05B 81/20 292/49
2009/0045214 A1 * 2/2009 Kobayashi ..... G07F 9/02 221/154
2009/0139516 A1 * 6/2009 Augustyn et al. ..... 128/200.23
2010/0012538 A1 * 1/2010 Brunner ..... E05C 1/10 206/373
2010/0210326 A1 * 8/2010 Ladouceur ..... H04M 1/0214 455/575.3
2010/0308070 A1 * 12/2010 Clarke ..... G07F 11/44 221/1
2011/0042404 A1 * 2/2011 Koike et al. ..... 221/2
2011/0100992 A1 * 5/2011 Zhang ..... E05B 73/0023 220/324
2011/0160666 A1 6/2011 Hanson et al.
2011/0163112 A1 * 7/2011 Takahama ..... 221/277
2011/0219695 A1 * 9/2011 Ivasiv ..... E05B 61/00 49/394
2013/0119063 A1 * 5/2013 Cowie ..... E05B 65/5238 220/315
2013/0256256 A1 * 10/2013 Krippendorf ..... E05B 43/005 215/200
2013/0284755 A1 * 10/2013 Yuyama et al. ..... 221/13
2014/0132137 A1 * 5/2014 Wu ..... B41J 29/13 312/298

* cited by examiner

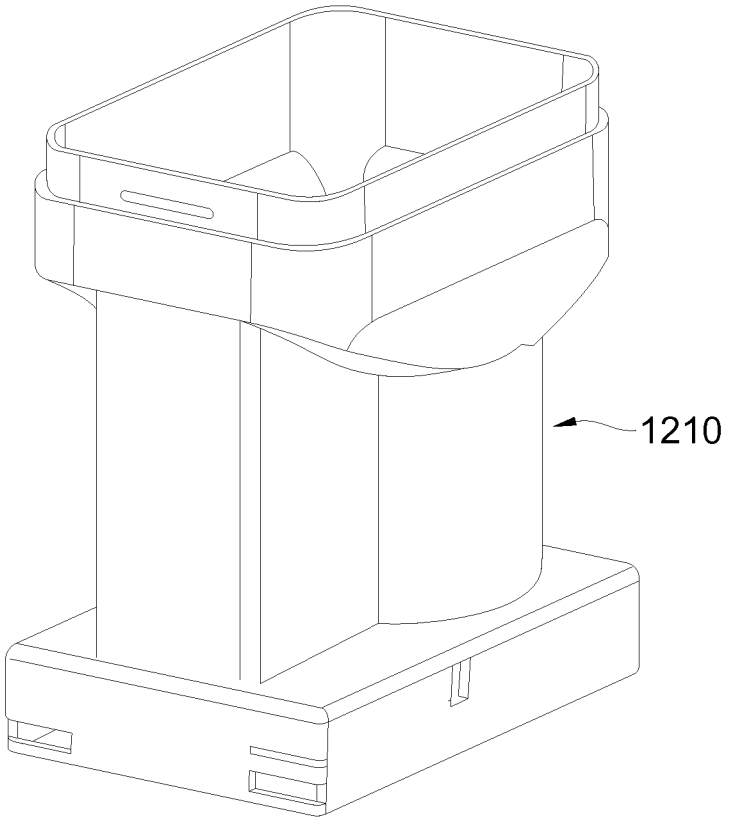
FIG. 15
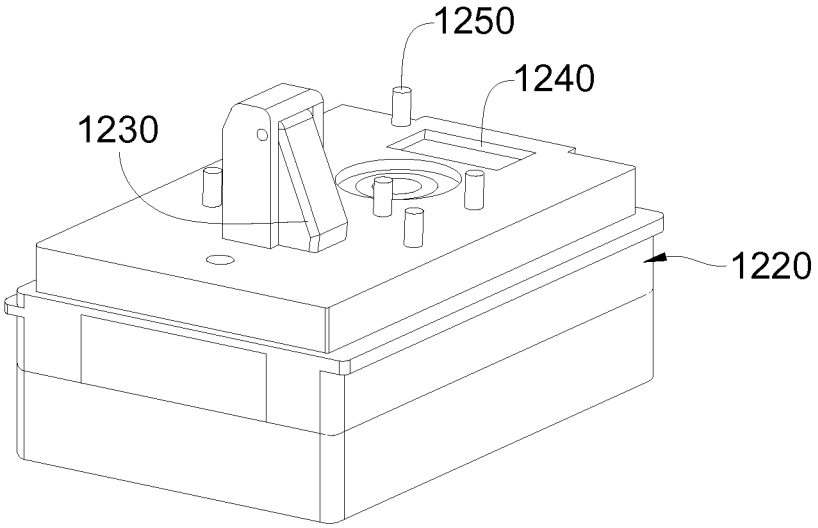

LOCKING CANISTER FOR DISPENSING MEDICATIONS

I. FIELD OF THE INVENTION

The disclosure generally relates to systems and methods for a locking canister and more particularly to a locking canister for retaining and selectively dispensing medications.

II. BACKGROUND OF THE INVENTION

A wide variety of medications are currently on the market. Many medications are carefully regulated and may be approved for use for particular conditions and may require a prescription prior to dispensing. Some drugs may have significant monetary value, creating a risk of diversion for profit or misappropriation for unapproved uses. Some drugs, such as pain killers including but not limited to narcotics, may be prone to abuse increasing the risk of theft or diversion if not properly monitored and secured from production to initial receipt production to dispensing to patients.

There is a need to address the foregoing deficiencies in the art.

III. BRIEF DESCRIPTION OF THE DRAWINGS

FIG. 15 depicts a locking canister and base station in accordance with certain embodiments.

IV. DETAILED DESCRIPTION

Figure 1:
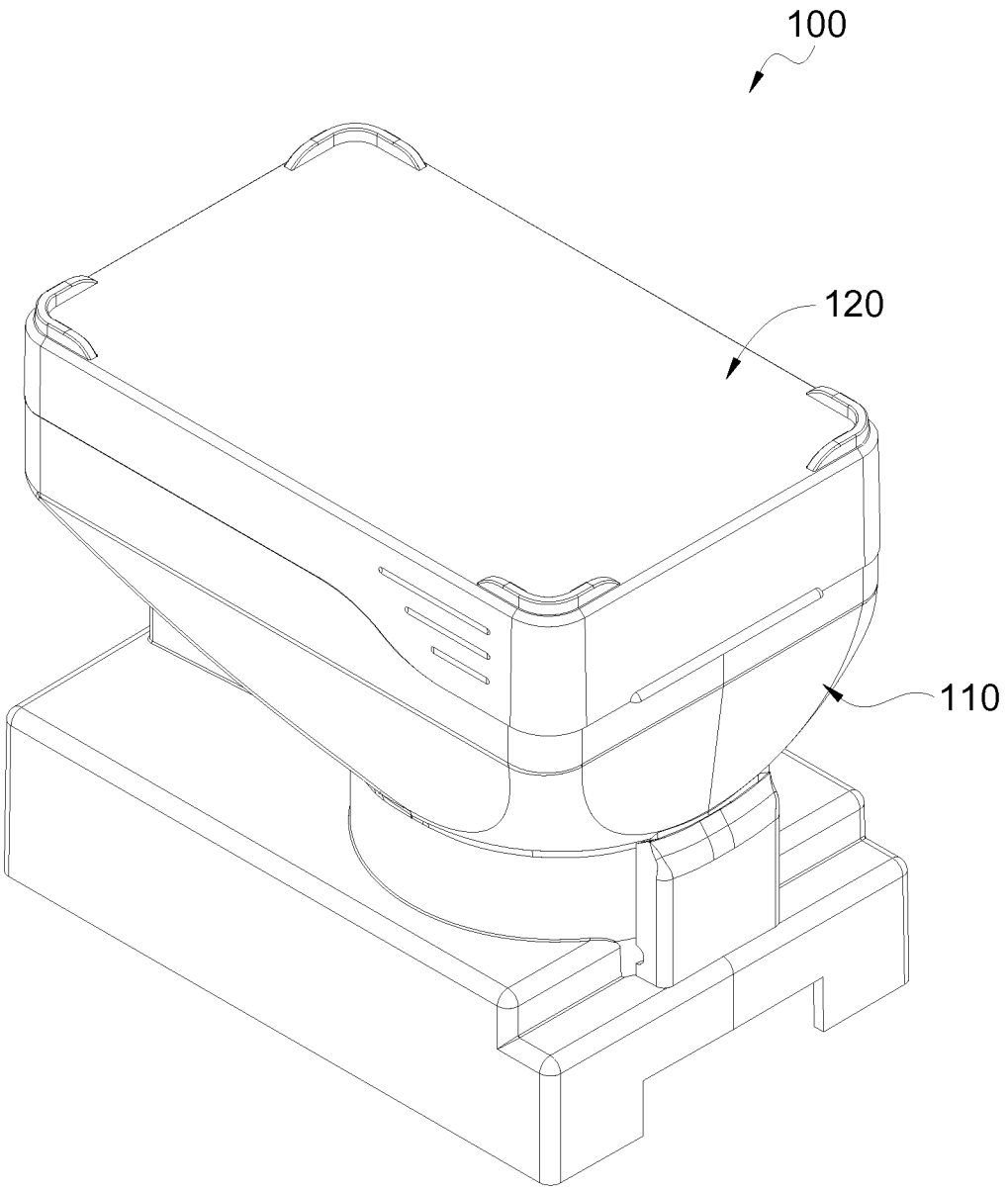
FIG. 1 depicts a locking canister in accordance with certain embodiments.

In certain embodiments, a locking canister for dispensing pharmaceuticals is disclosed, comprising: a canister housing for retaining one or more doses of medication; a medication release mechanism for selectively releasing one or more of the one or more doses of medication from the canister housing; and one or more locking mechanisms for preventing the unauthorized release of medication from the canister. The medication release mechanism may comprise a retractable portion, the retractable portion having a closed position and a retracted position and configured to be selectively moved from the closed position to the retracted position to dispense one or more doses of medication from the canister. The retractable portion may comprise a rotating shutter. At least one of the one or more locking mechanisms may be configured for locking the retractable portion in at least one of the closed and the retracted position. At least one of the one or more locking mechanisms may comprise a worm gear for selectively rotating the retractable portion between the closed position and the retracted position. At least one of the one or more locking mechanisms may comprise a worm gear for selectively locking the retractable portion in at least one of the closed position and the retracted position. At least one of the one or more locking mechanisms may comprise a rotating portion for locking the retractable portion in the closed position when rotated to an over center position. The canister may further comprise: a canister printed circuit board; a motor; and a base unit for selectively connecting to a bottom surface of the canister, the base unit comprising: a main PCB, which connects the motor to the canister printed circuit board for operating the medication release mechanism when the base unit is connected to the canister and which prevents dispensing of medications when the base unit is not attached to the canister. The canister may further comprise a motor for moving the retractable portion between the closed and the retracted positions. The canister may further comprise a solenoid for moving the retractable portion between the closed and the retracted positions. The medication release mechanism may comprise an index wheel for dispensing medication one dose at a time. The canister may further comprise a retaining member to prevent unauthorized movement of the index wheel. The one or more locking mechanisms may comprise one or more movable tabs each comprising: a locked position for locking the retractable portion in the closed position; an unlocked position for permitting the retractable portion to be selectively moved between the retracted position and the closed position; and a biasing mechanism for biasing the one or more movable tabs in the locked position.

In certain embodiments, a locking canister for dispensing pharmaceuticals is disclosed, comprising: a canister housing comprising an outer portion, an inner portion and one or more lock features; a canister cover for locking to the canister housing to enclose the inner portion; one or more locking mechanisms attached to the canister cover for selectively engaging one or more of the lock features; and a medication release mechanism for selectively releasing one or more doses of medication from the canister. The one or more lock features may comprise one or more of a fixed tab 620*a*, a strike plate 620*b*, a rib 620*c*, and a recess 620. Each of the one or more locking mechanisms may comprise: a movable locking element movably attached to the canister cover, the movable locking element comprising: a motive portion to move the locking element to an unlocked position; and a locking tab for engaging one of the lock features to lock the canister cover to the canister housing when the movable locking element is in a locked position. Each of the one or more locking mechanisms may comprise: a pivoting locking element pivotably attached to the canister cover, the pivoting locking element comprising: a magnetic portion to move the locking element to an unlocked position; and a locking tab for engaging one of the lock features to lock the canister cover to the canister housing when the pivoting locking element is in a locked position. The locking tab for each of the one or more locking mechanisms may not be accessible when the canister cover is locked to the canister housing. The one or more locking mechanisms may not be visible when the canister cover is locked to the canister housing. Each of the one or more locking mechanisms further may comprise a biasing mechanism for biasing the movable locking element in the locked position. The biasing mechanism may comprise a selected one of a leaf spring, a compression spring, a torsion spring, a molded-in-plastic spring, an extension spring, an elastomeric spring, and a magnetic biasing mechanism. The canister cover further may comprise one or more fixed locking tabs for engaging one or more recesses in the canister housing. The one or more lock features may comprise a first recess in a first side of the inner portion and a second recess in a second side of the inner portion opposite the first side. The one or more locking mechanisms may comprise a first locking mechanism comprising a first locking tab for engaging the first recess and a second locking mechanism comprising a second locking tab for engaging the second recess. The canister may be configured to be unlocked by placing the canister housing and canister cover into a cover removal fixture, the cover removal fixture comprising a first magnet for engaging the first magnetic portion to unlock the first locking mechanism and a second magnet for engaging the second magnetic portion to unlock the second locking mechanism. The medication release mechanism may comprise a retractable portion, the retractable portion having a closed position and a refracted position and configured to be selectively moved from the closed position to the retracted position to dispense one or more doses of medication from the canister. The retractable portion may comprise a rotating shutter. The canister may further comprise a medication locking mechanism for locking the retractable portion in at least one of the closed and the retracted position. The medication locking mechanism may comprise a worm gear for selectively rotating the retractable portion between the closed position and the refracted position. The medication locking mechanism may comprise a worm gear for selectively locking the retractable portion in at least one of the closed position and the retracted position. The medication locking mechanism may comprise a rotating portion for locking the retractable portion in the closed position when rotated to an over center position. The canister may further comprise: a canister printed circuit board; a motor; and a base unit for selectively connecting to a bottom surface of the canister, the base unit comprising: a main PCB, which connects the motor to the canister printed circuit board for operating the medication release mechanism when the base unit is connected to the canister and for preventing dispensing of medications when the base unit may not be attached to the canister. The canister may further comprise a motor for moving the retractable portion between the closed and the retracted positions. The canister may further comprise a solenoid for moving the retractable portion between the closed and the retracted positions. The medication release mechanism may comprise an index wheel for dispensing medication one dose at a time. The canister may further comprise a retaining member to prevent unauthorized movement of the index wheel. The medication locking mechanism may comprise one or more movable tabs each comprising: a locked position for locking the retractable portion in the closed position; an unlocked position for permitting the retractable portion to be selectively moved between the retracted position and the closed position; and a biasing mechanism for biasing the one or more movable tabs in the locked position.

In certain embodiments, a method of locking a canister to retain pharmaceuticals therein is disclosed, comprising: providing a canister housing comprising: a medication release mechanism for selectively releasing one or more doses of medication from the canister housing; and a locking mechanism for preventing the unauthorized release of doses of medication from the canister; loading one or more doses of medication in the canister housing; locking the canister housing. The medication release mechanism may comprise a retractable portion, the retractable portion having a closed position and a refracted position and configured to be selectively moved from the closed position to the retracted position to dispense one or more doses of medication from the canister. The retractable portion may comprise a rotating shutter. The locking mechanism is configured for locking the retractable portion in at least one of the closed and the retracted position. The locking mechanism may comprise a worm gear for selectively rotating the retractable portion between the closed position and the retracted position. The locking mechanism may comprise a worm gear for selectively locking the retractable portion in at least one of the closed position and the retracted position. The locking mechanism may comprise a rotating portion for locking the retractable portion in the closed position when rotated to an over center position. The canister housing further may comprise: a canister printed circuit board; a motor; and a base unit for selectively connecting to a bottom surface of the canister, the base unit comprising: a main PCB, which connects the motor to the canister printed circuit board for operating the medication release mechanism when the base unit is connected to the canister and which prevents dispensing of medications when the base unit may not be attached to the canister. The canister housing further may comprise a motor for moving the retractable portion between the closed and the retracted positions. The canister housing further may comprise a solenoid for moving the retractable portion between the closed and the retracted positions. The medication release mechanism may comprise an index wheel for dispensing medication one dose at a time. The canister housing further may comprise a retaining member to prevent unauthorized movement of the index wheel. The locking mechanism may comprise one or more movable tabs each comprising: a locked position for locking the retractable portion in the closed position; an unlocked position for permitting the retractable portion to be selectively moved between the retracted position and the closed position; and a biasing mechanism for biasing the one or more movable tabs in the locked position.

In certain embodiments, a method of locking a canister to retain pharmaceuticals therein is disclosed, comprising: providing a canister housing comprising an outer portion, an inner portion and one or more lock features; providing a canister cover comprising one or more locking mechanisms for locking the canister cover to the canister housing to enclose the inner portion; providing a medication locking mechanism to prevent any unauthorized dispensing of medications; inserting one or more doses of medication into the inner portion; locking the canister cover to the canister housing; unlocking the medication locking mechanism; and dispensing one or more of the one or more doses of medication from the canister. Each of the one or more locking mechanisms may comprise: a movable locking element movably attached to the canister cover, the movable locking element comprising: a motive portion to move the locking element to an unlocked position; and a locking tab for engaging one of the lock features; and wherein the step of locking may comprise moving the movable locking element to a locked position. Each of the one or more locking mechanisms may comprise: a pivoting locking element pivotably attached to the canister cover, the pivoting locking element comprising: a magnetic portion to move the locking element to an unlocked position; and wherein the step of locking may comprise engaging one of the lock features with a locking tab to lock the canister cover to the canister housing. The one or more lock features may comprise one or more of a fixed tab, a strike plate, a rib, and a recess. The locking tab for each of the one or more locking mechanisms may not be accessible when the canister cover is locked to the canister housing. The method may further comprise biasing the movable locking element in the locked position. The step of biasing is accomplished at least in part by a selected one of a leaf spring, a compression spring, a torsion spring, a molded-in-plastic spring, a magnetic biasing mechanism and a pneumatic biasing mechanism. The canister cover further may comprise one or more fixed locking tabs and wherein the step of locking further may comprise engaging the one or more fixed locking tabs in a corresponding one or more recesses in the canister housing. The one or more lock features may comprise a first recess in a first side of the inner portion and a second recess in a second side of the inner portion opposite the first side. The step of locking may comprise engaging a first locking tab of a first locking mechanism in the first recess and engaging a second locking tab of a second locking mechanism in the second recess. The method may further comprise: placing the canister housing and canister cover into a cover removal fixture comprising a first magnet and a second magnet, such that the first magnet engages the first magnetic portion to unlock the first locking mechanism and the second magnet engages the second magnetic portion to unlock the second locking mechanism; and removing the canister cover from the canister housing. The canister housing may comprise a retractable portion, the retractable portion having a closed position and a refracted position. The method may further comprise locking the retractable portion in the at least one of the closed and the retracted position. The method may further comprise moving the retractable portion to the retracted position to selectively dispense one or more doses of medication. The step of selectively dispensing may comprise moving the retractable portion from the closed position to the retracted position to dispense one or more doses of medication from the canister. The retractable portion may comprise a rotating shutter. The method may further comprise locking the retractable portion in at least one of the closed and the retracted position. The step of locking the retractable portion may be performed at least in part by a worm gear. The step of locking the retractable portion may comprise rotating a rotating portion to an over center position. The canister housing further may comprise a canister printed circuit board; and a motor; and may further comprise providing a base unit for selectively connecting to the canister, the base unit comprising a main PCB; and connecting the base unit to the canister housing. The step of selectively dispensing one or more doses of medication from the canister can only be performed when the base unit is connected to the canister. The step of moving the retractable portion may be performed at least in part by a motor. The step of moving the retractable portion may be performed at least in part by a solenoid. The step of selectively dispensing may comprise rotating an index wheel to dispense medication one dose at a time. The canister further may comprise a retaining member to prevent unauthorized movement of the index wheel. The step of moving the retractable portion may comprise moving one or more movable tabs from a locked position that locks the retractable portion in the closed position to an unlocked position that permits the retractable portion to be selectively moved between the closed position and the retracted position; and moving the retractable portion from the closed position to the retracted position.

In certain embodiments, a lockable canister for retaining and selectively dispensing medications is disclosed. To prevent drug diversion, a plurality of doses of medication may be loaded into the locking canister at a central pharmacy and then the canister may be locked to prevent unauthorized removal of medication in transit to a remote dispensing unit that may be located in a remote pharmacy. The remote pharmacy may be located in a long term care facility to permit the medications to be dispensed in the appropriate dosage for a particular patient at the intervals specified by a prescribing physician. The lockable canister may include a canister housing and a canister cover that may be affixed to the canister housing to enclose the plurality of doses of medication. The canister cover may include tamper evident or tamper resistant features. For example, tamper evident tape may be used to indicate if the lockable canister has been tampered with in transit or between inventories. Alternately or in addition to features to render the canister tamper evident, the canister may include one or more locking mechanisms to prevent unauthorized access to the medication in the canister in transit or before it is specifically authorized for dispensing.

In certain embodiments, the canister may include a medication release mechanism for selectively releasing one or more doses of medication from the canister. The one or more doses of medication may be dispensed under control of an automated dispensing unit.

The medication release mechanism may include a medication locking mechanism for preventing unauthorized release of medication via the medication release mechanism. For example, once the canister is filled at the central pharmacy, the medication release mechanism may be locked using the medication locking mechanism during transit from the central pharmacy to a remote pharmacy. The medication release mechanism may remain locked until the canister is placed into an automated dispensing unit. In certain embodiments, the medication release mechanism may remain locked until the canister receives a command authorizing release of one or more doses of medication. In certain embodiments, software or firmware may cause the canister medication release mechanism to unlock only after the canister is installed in an automated dispensing unit and the correct dispensing command is released. In certain embodiments, the medication release mechanism must be locked before the canister can be removed from an automated dispensing unit. In certain embodiments, the canister must be locked into an automated dispensing unit before the medication locking mechanism can be unlocked to permit the medication release mechanism to dispense one or more doses of medication upon receipt of an authorized command to dispense medication.

Figure 2:
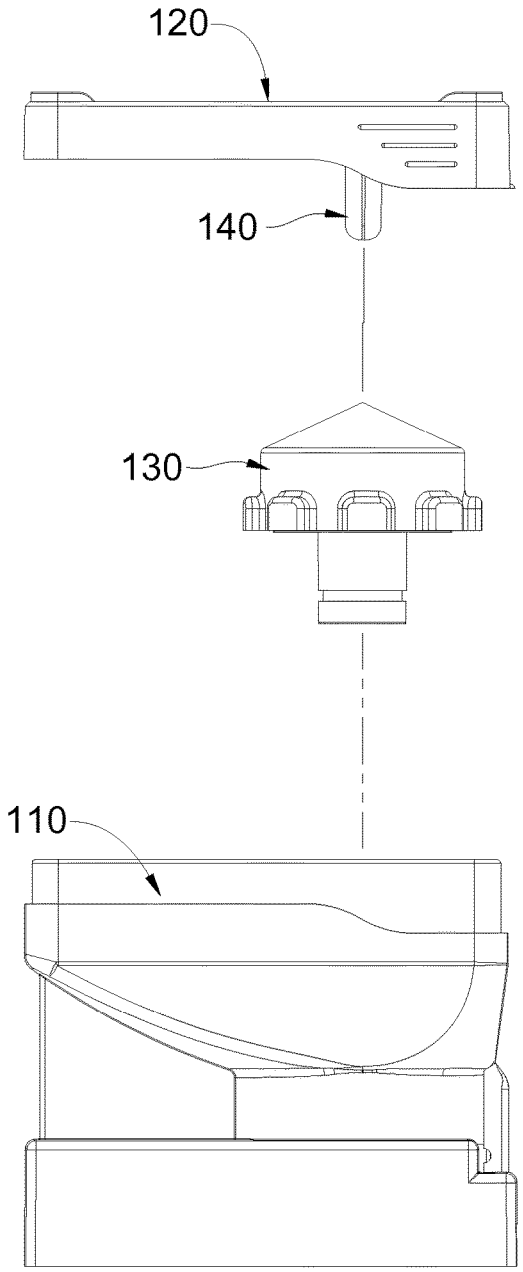
FIG. 2 depicts an exploded side view of the locking canister of FIG. 1 in accordance with certain embodiments.
Figure 3:
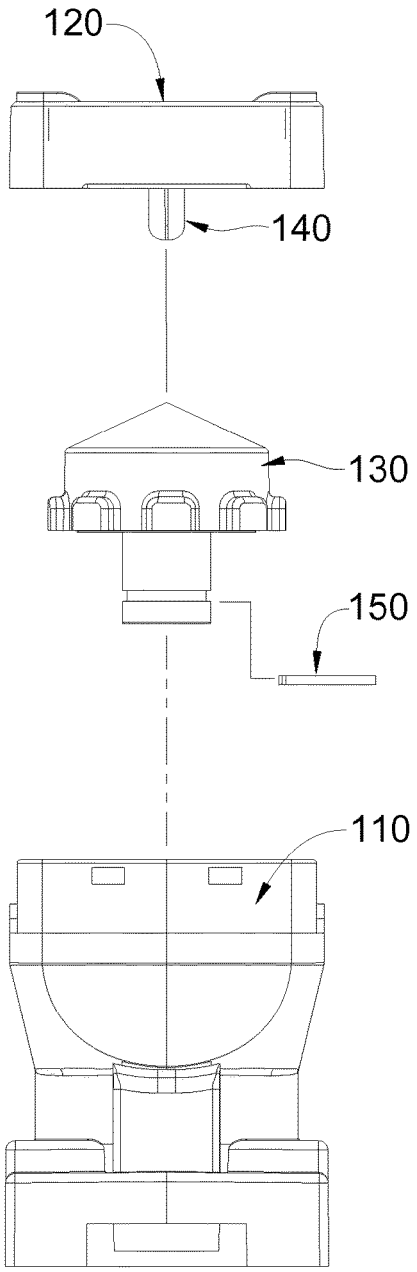
FIG. 3 depicts an exploded end view of the locking canister of FIG. 1 in accordance with certain embodiments.

In certain embodiments as shown in FIGS. 1-3, a lockable canister 100 may include a canister housing 110 and a canister cover 120 for locking to the canister housing to enclose one or more doses of medication within the canister. The canister may include a medication release mechanism including an index wheel 130 that may selectively be rotated to dispense one dose of medication at a time. The index wheel 130 may be held in place by a retaining clip 150. In certain embodiments, the canister may further include a retaining member 140 to prevent unauthorized movement of the index wheel 130, including but not limited to movement of the index wheel 130 to manually remove one or more doses of medication without authorization. The retaining member 140 may prevent someone from removing the retaining clip 150 that holds the index wheel 130 to the canister housing 110. If a person were to remove the retaining clip 150, he or she could push the index wheel 130 up into the canister housing 110 high enough to allow pills to fall through the hole on the bottom of the canister housing 110 such that medications could be stolen. The retaining member 140 permits the use of index wheel 130 to selectively dispense doses of medication while preventing tampering with the locking canister and theft or diversion of medications.

Figure 4:
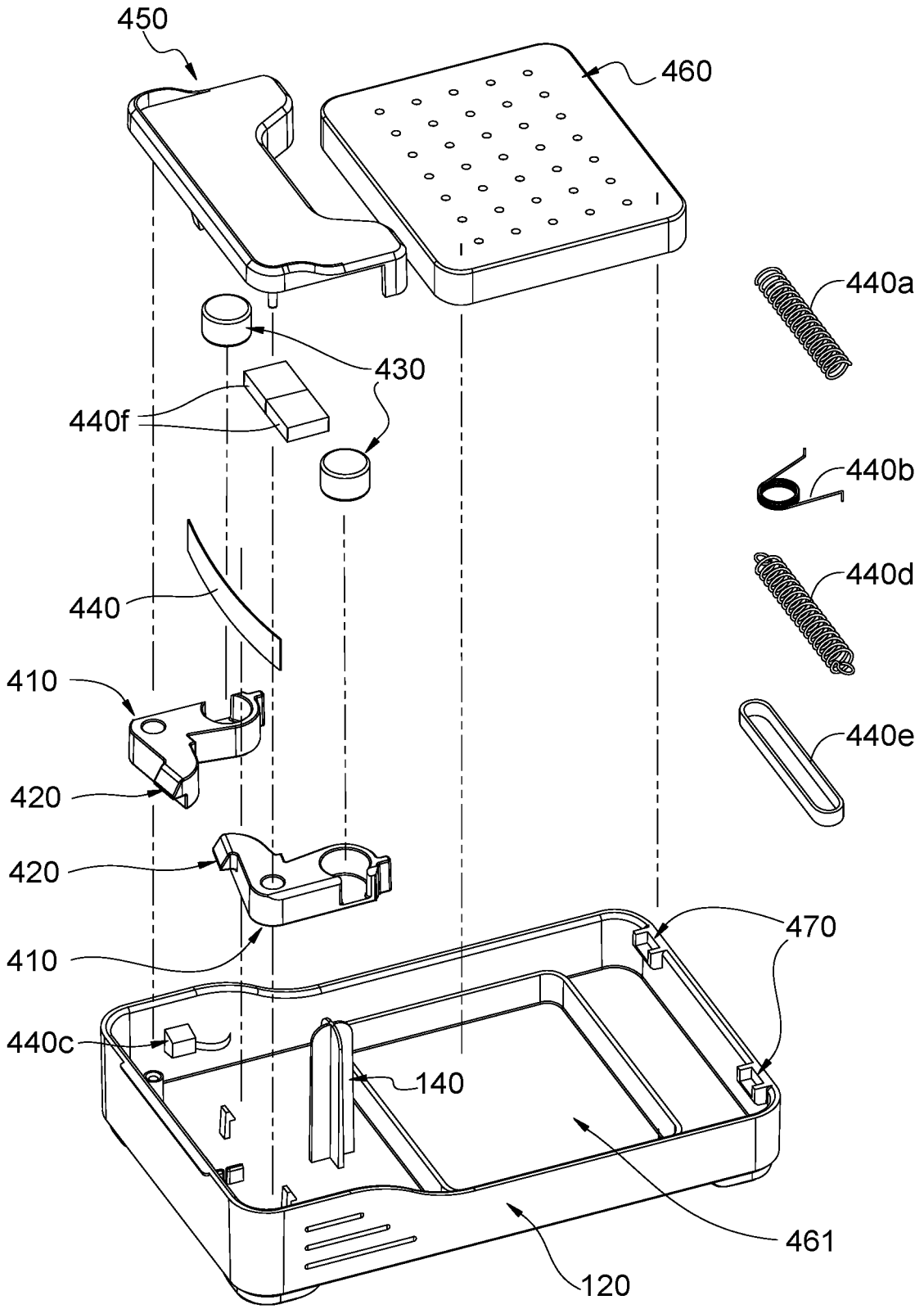
FIG. 4 depicts an exploded view of a canister cover in accordance with certain embodiments.

In certain embodiments as shown in FIG. 4, the canister cover 120 may include one or more locking mechanisms for locking the canister cover 120 to a canister housing 110 to prevent unauthorized access to medication stored within the canister. One of ordinary skill in the art will understand that a wide variety of locking mechanisms may be used for locking a canister cover 120 to a canister housing 110 and that the locking mechanisms depicted in the drawings and described herein are merely exemplary and not intended to be limiting. In certain embodiments, a locking mechanism may include pivoting locking element 410, which may be pivotably attached to the canister cover. Pivoting locking element 410 may include one more locking tabs 420 for engaging one or more lock features on or in the canister housing, which may include but are not limited to one or more recesses 610 (shown in FIG. 9) disposed to be engaged by the one or more locking tabs 420. The one or more locking mechanisms may include magnetic elements 430 for moving the locking mechanism to an unlocked position when a magnet is placed in proximity to the magnetic elements 430. The magnetic elements 430 may include without limitation, a magnet, a steel insert or some other ferrous or other magnetic material upon which a magnet can apply a force to pivot the locking mechanism from a locked to an unlocked position. In certain embodiments, the one or more pivoting locking elements 410 may be biased in a locked position by one or more biasing mechanisms 440. In certain embodiments, the one or more biasing mechanisms 440 may include a selected one of a leaf spring 440, a compression spring 440*a*, a torsion spring 440*b*, a molded-in-plastic spring 440*c*, an extension spring 440*d*, an elastomeric spring 440*e*, and a magnetic biasing mechanism 440*f*. In certain embodiments, the canister cover 120 may further include one or more fixed locking tabs 470 for engaging one or more recesses 620 (shown in FIG. 9) in the canister housing 110. The canister cover 120 may also include a locking mechanism cover plate 450 for enclosing the one or more locking mechanisms. The cover plate 450 may be permanently attached to the canister cover 120 with ultrasonic welding, an adhesive, heat staking, snap-tabs, security screws or other manufacturing processes known to those of ordinary skill in the art that do not allow the cover plate 450 to be removed after it has been assembled. The one or more locking mechanisms may not be visible and/or accessible when the canister cover 120 is locked to the canister housing 110. The canister cover 120 may also include a cavity 461 and a cover plate 460 to retain a desiccant packet in the canister cover that can remove humidity from the inner portion of the canister housing 110 when the canister cover 120 is attached to the canister housing 110.

One of skill in the art will recognize that the locking mechanism shown in FIG. 4 is merely exemplary and that a variety of different locking mechanisms can be used without departing from the scope of the invention. For example, a lock cylinder with a "D" or "double D" cylinder profile may be assembled to the top cover with a retaining component on the bottom side, which may include without limitation a nut or a spring-clip similar to traditional lock cylinders. At the bottom of the lock cylinder, a camming element, which may be a stamping, may rotate 90 degrees and latch under a lock feature which may include without limitation a rib detail or a slot in the side of the canister housing 110.

Figure 5:
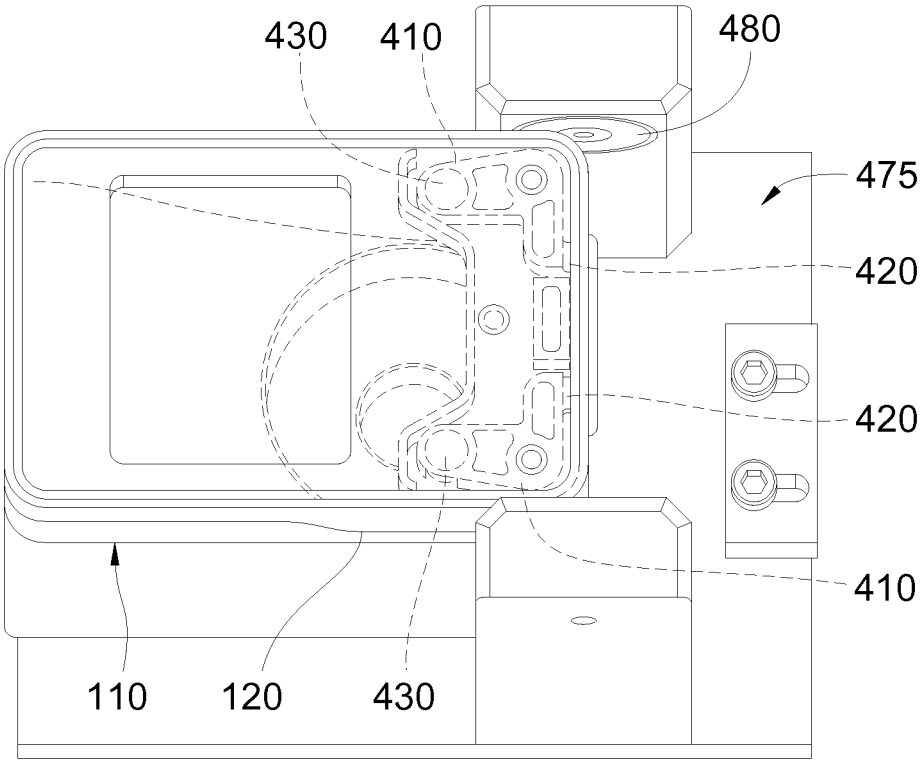
FIG. 5 depicts a canister and cover removal fixture in accordance with certain embodiments.
Figure 6:
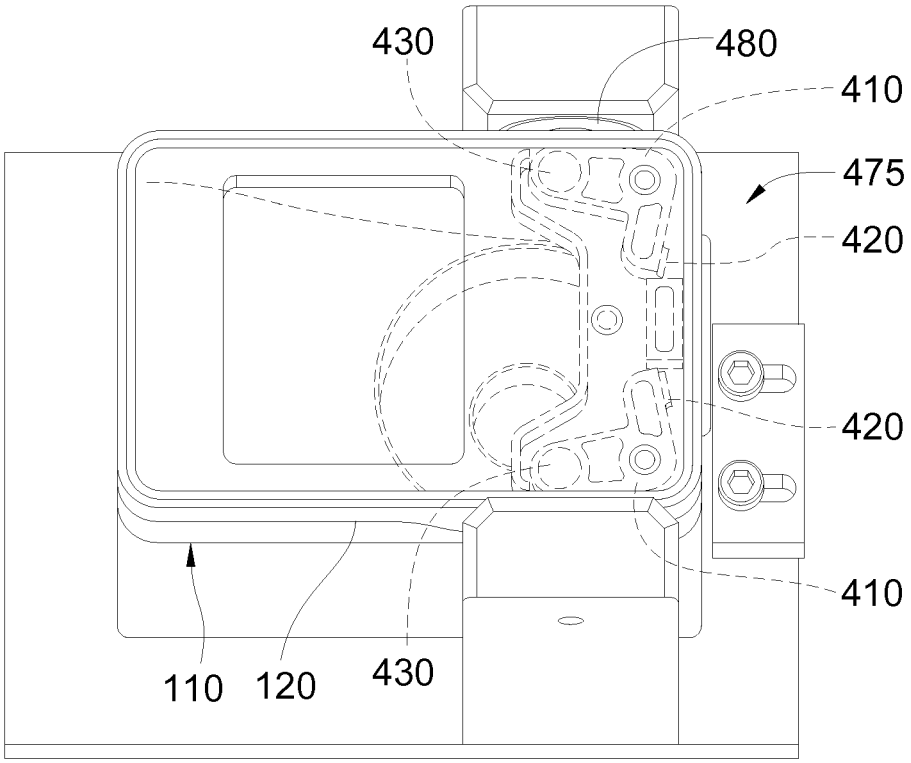
FIG. 6 depicts a canister and cover removal fixture in accordance with certain embodiments.
Figure 7:
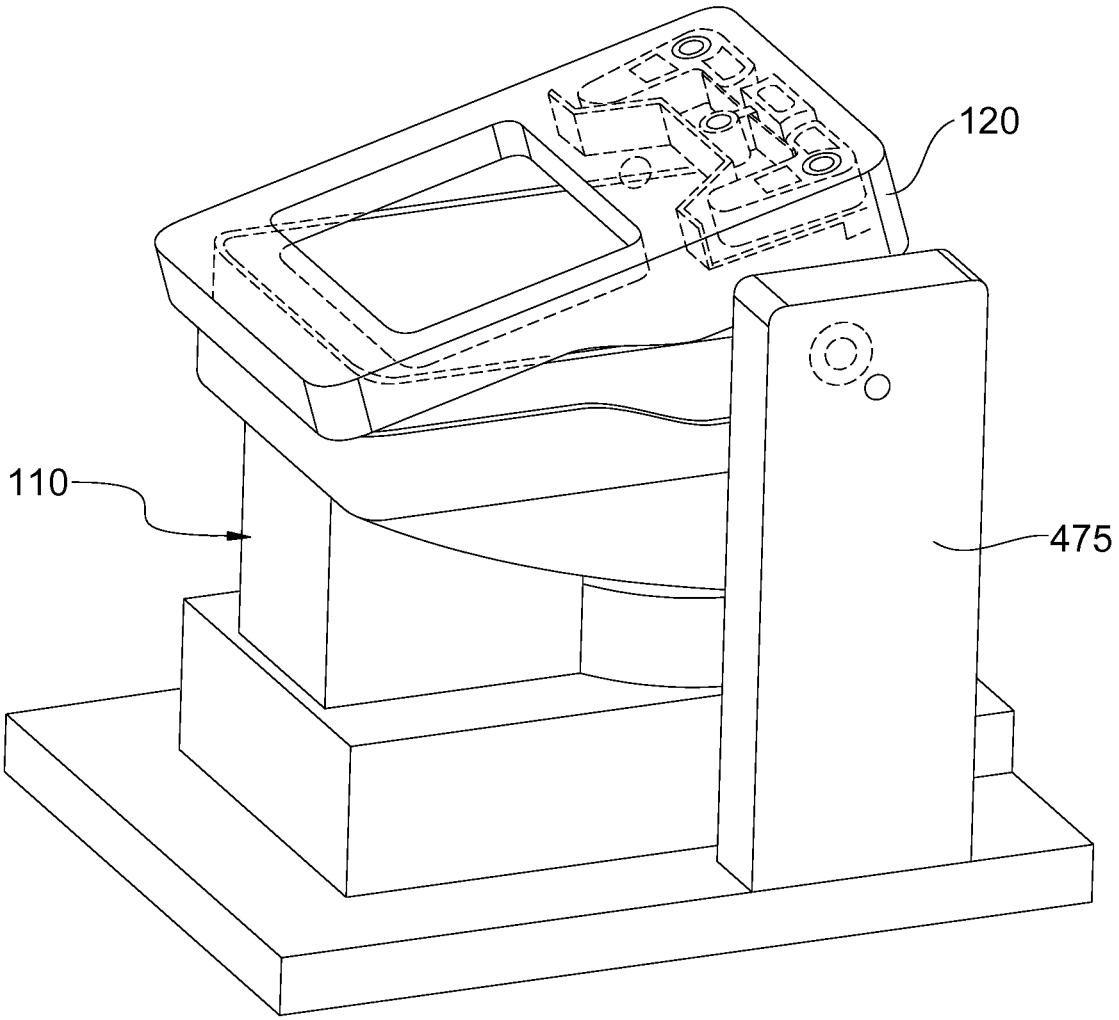
FIG. 7 depicts a canister and cover removal fixture in accordance with certain embodiments.

In certain embodiments as shown in FIGS. 5-7, the canister cover 120 may be configured to be unlocked to permit removal of the canister cover 120 from the canister housing 110 by placing the canister housing 110 with the canister cover 120 attached to the canister housing 110 into a cover removal fixture 475. The cover removal fixture 475 may include a magnet 480 for engaging the magnetic elements 430 of each of the one or more locking mechanisms. If the canister cover 120 includes more than one locking mechanism, the cover removal fixture 475 may be configured to include a magnet 480 for each locking mechanism and the respective magnets 480 may be located within the cover removal fixture 475 to permit all of the one or more locking mechanisms to be simultaneously unlocked when the locked canister is placed in the cover removal fixture 475. In certain embodiments, FIG. 5 displays a canister with the canister cover 120 locked to the canister housing 110. As shown in FIG. 5, before the canister is moved to place the one or more locking mechanisms in proximity to the one or more magnets 480, the locking tabs 420 on the pivoting locking elements 410 engage lock features 610 (shown in FIG. 9) to lock the canister cover 120 to the canister housing 110. As shown in FIG. 6, when the canister is moved to place the one or more locking mechanisms in proximity to the one or more magnets 480, the magnets 480 engage the magnetic elements 430 in the one or more pivoting locking elements 410, to pivot the pivoting locking elements 410 from the locked position shown in FIG. 5 to the unlocked position shown in FIG. 6. In certain embodiments as shown in FIG. 7, when the pivoting locking elements 410 are in the unlocked position, canister cover 120 may be removed from canister housing 110 to provide access to the inside of canister housing 110.

In certain embodiments, on the opposite side of the canister cover 120 from the locking tabs 420, there may be one or more fixed locking tabs 470 extending from the inside of a skirt on the top cover. The one or more fixed locking tabs 470 extend through one or more slots or openings 620 in the top wall of the canister housing 110 on the opposite side of the canister housing 110 from the one or more slots 610 that interact with the pivoting locking element 410. The skirt on the canister cover 120 prevents someone from sliding the canister cover 120 horizontally to try to push the locking tabs 420 out of their slots in the canister housing 110.

In certain embodiments, to allow for the canister cover 120 to be installed onto the top of the canister housing 110 without the top cover removal fixture 475, the one or more pivoting locking elements 410 may have a chamfer on the bottom edge such that they will pivot to the unlocked position similar to a common door latch mechanism. The canister cover 120 may be installed onto the canister housing 110 by first inserting one or more fixed locking tabs 470 into one or more recesses 620 (shown in FIG. 9) as displayed in FIG. 7. Then, the canister cover 120 may be rotated down onto the canister housing 110 until the locking tabs 420 first come into contact with the canister housing 110 and then pivot to the unlocked position similar to a common door latch mechanism. In certain embodiments, once the canister cover 120 is fully inserted onto the canister housing 110, the locking tabs 420 may be pivoted to the locked position by biasing mechanism 440.

Figure 8:
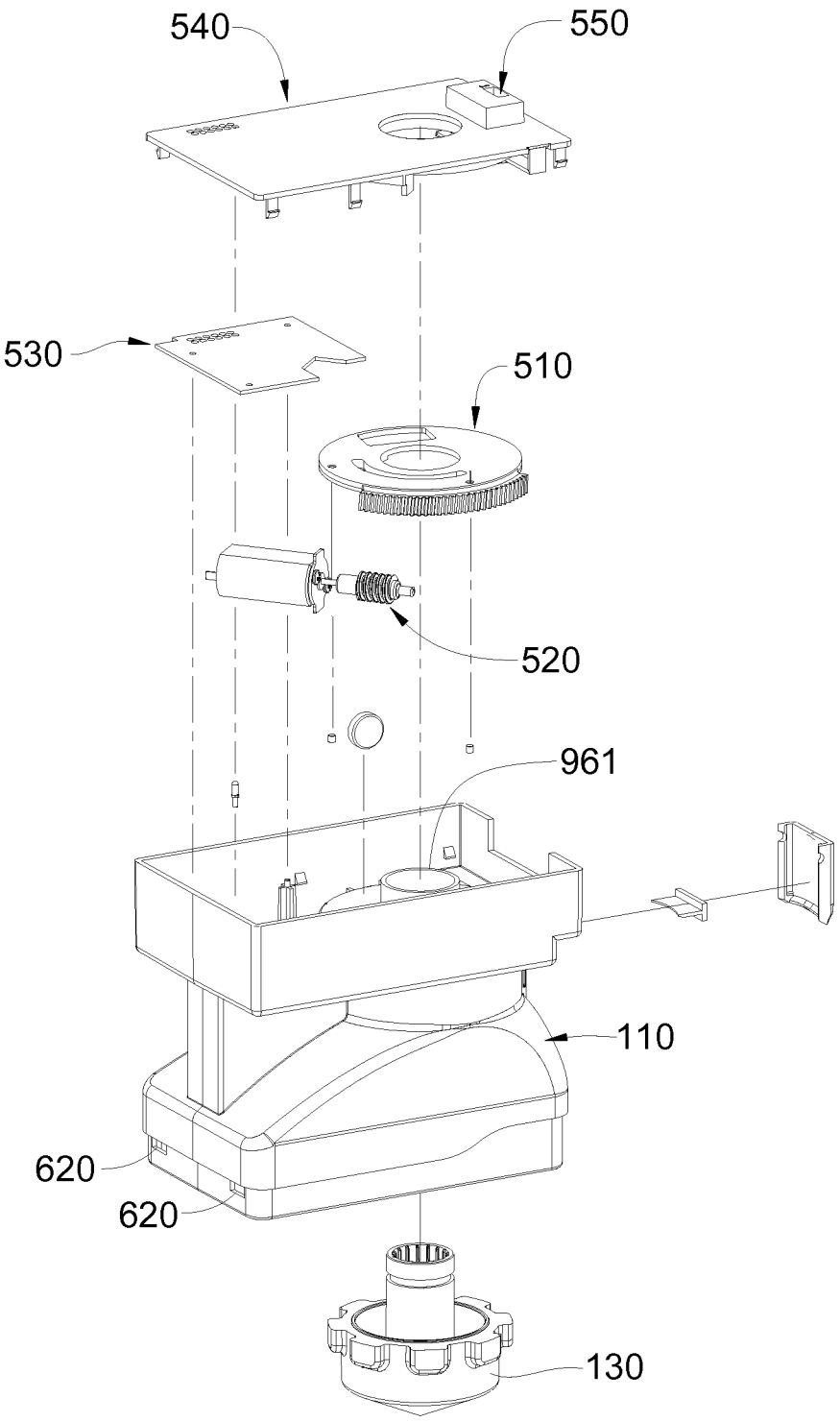
FIG. 8 depicts an exploded view of a canister housing in accordance with certain embodiments.
Figure 9:
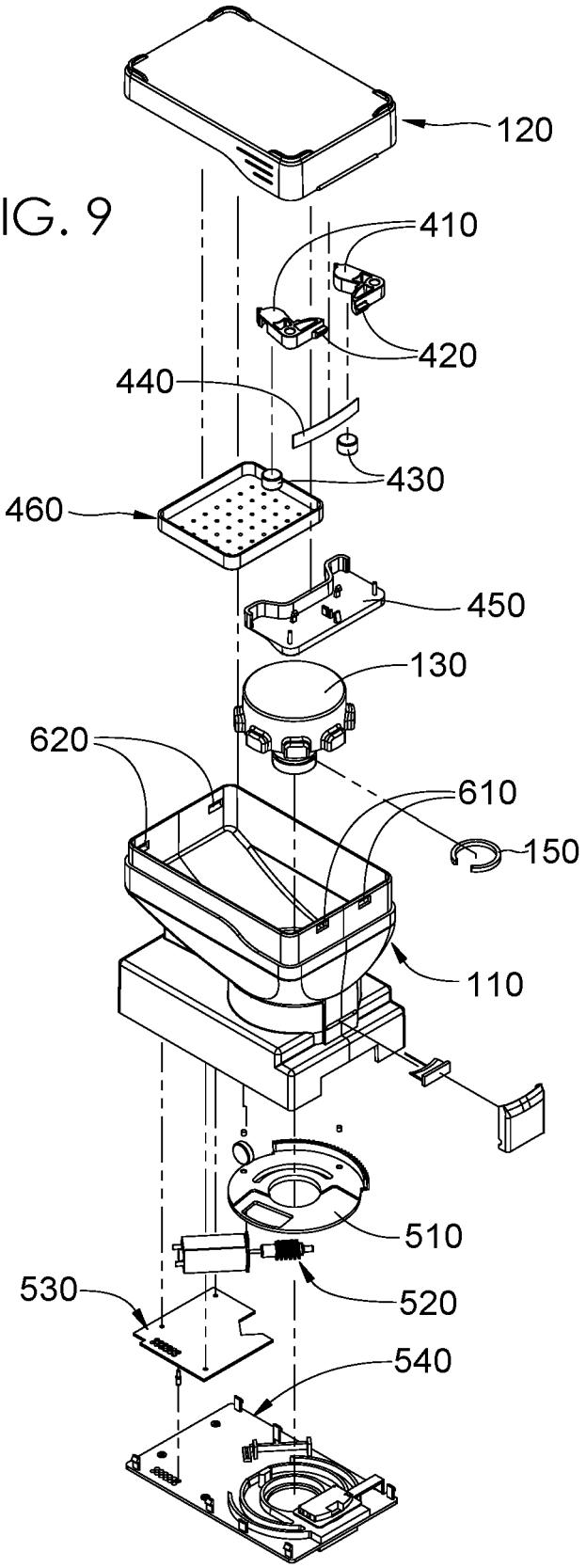
FIGS. 9-9C depicts exploded views of a locking canister including the canister cover of FIG. 4 and the canister housing of FIG. 8 in accordance with certain embodiments.
Figure 9A:
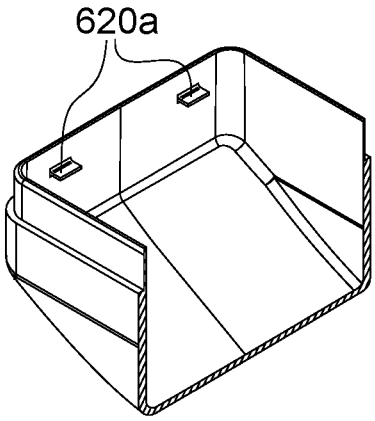
Figure 9B:
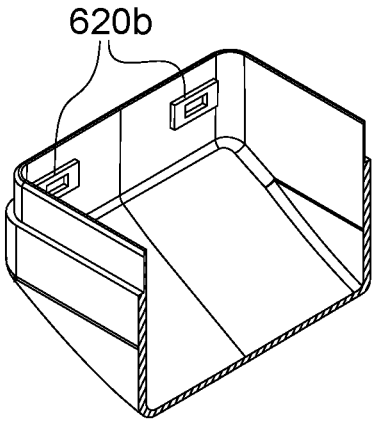
Figure 9C:
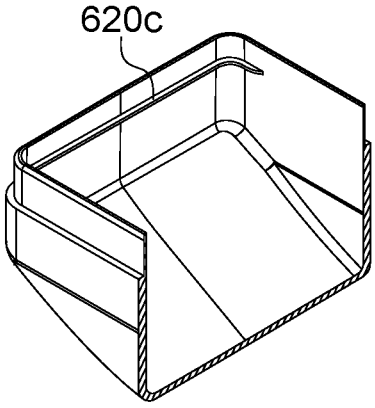

In certain embodiments as shown in FIG. 8, a canister housing 110 may include a medication release mechanism, which may include an index wheel 130 which may be used to selectively dispense medication one dose at a time. In certain embodiments, the rotation of the index wheel 130 may cause one or more doses of medication to be released from the bottom of the canister housing 110 via hole 550 in bottom cover plate 540. In certain embodiments, the canister housing 110 may include a medication locking mechanism for preventing unauthorized release of medication from the canister. In certain embodiments, the canister housing 110 may include a retractable portion that has a closed position and a retracted position. The retractable portion may include, without limitation, a rotating shutter 510 that may be selectively rotated between the closed position and the refracted position by a worm gear 520. The worm gear 520 may positively lock the rotating shutter 510 in a selected one of the closed position and the retracted position. The rotating shutter 510 and the worm gear 520 may be retained in place and protected from tampering by bottom cover plates 530 and 540. FIG. 9 depicts a locking canister combining the canister cover 120 of FIG. 4 and the canister housing 110 of FIG. 8.

Figure 10:
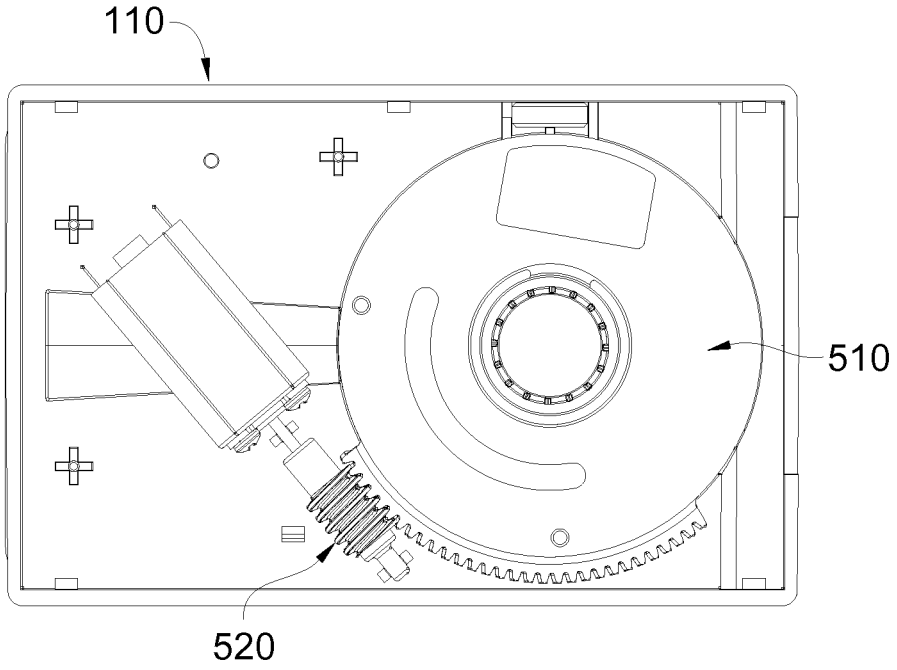
FIG. 10 depicts a medication release mechanism in accordance with certain embodiments.
Figure 11:
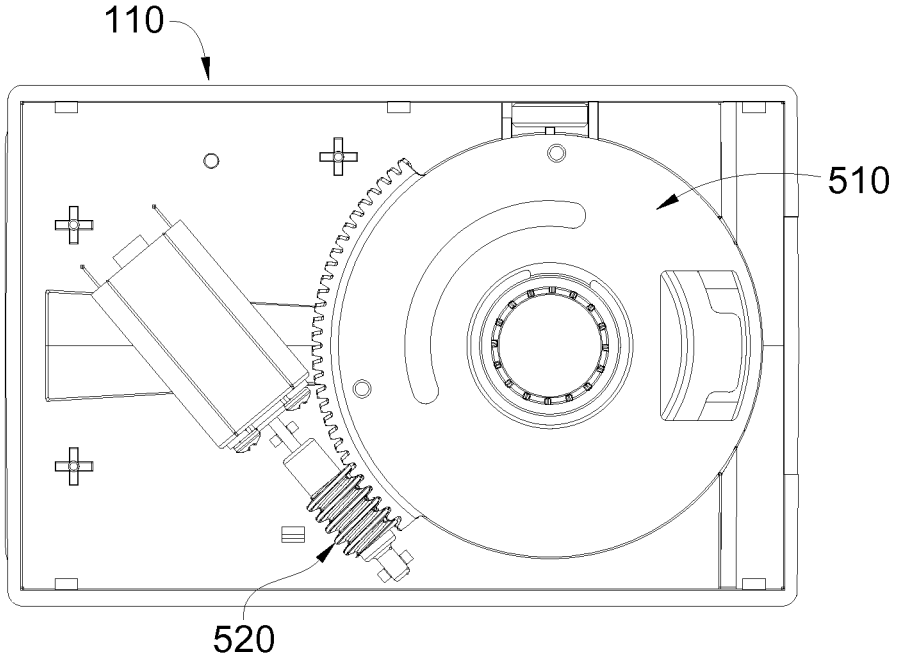
FIG. 11 depicts a medication release mechanism in accordance with certain embodiments.

In certain embodiments, a worm gear 520 may be used to selectively rotate rotating shutter 510 from a retracted position as shown in FIG. 10 to a closed position as shown in FIG. 11. In certain embodiments, the worm gear 520 may positively lock the rotating shutter 510 in the closed position to act as a medication locking mechanism to prevent unauthorized release of medication from the canister. In certain embodiments, the worm gear 520 may positively lock the rotating shutter 510 in the retracted position to permit the selective dispensing of one or more doses of medication. In certain embodiments, the worm gear 520 may lock the rotating shutter 510 in the closed position for transit from a central pharmacy to a remote pharmacy. In certain embodiments, the canister may only be removable from an automated dispensing unit if the rotating shutter 510 is locked in the closed position.

Figure 12B:
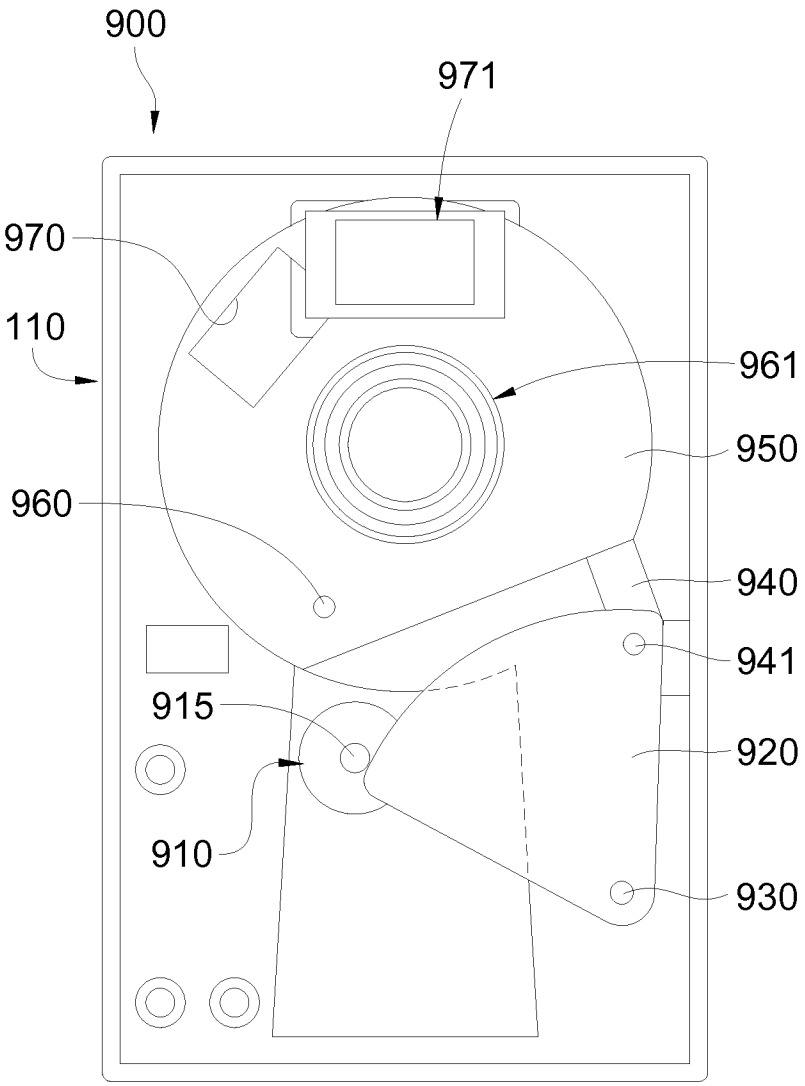
FIGS. 12A and 12B depict a medication release mechanism in accordance with certain embodiments.
Figure 12A:
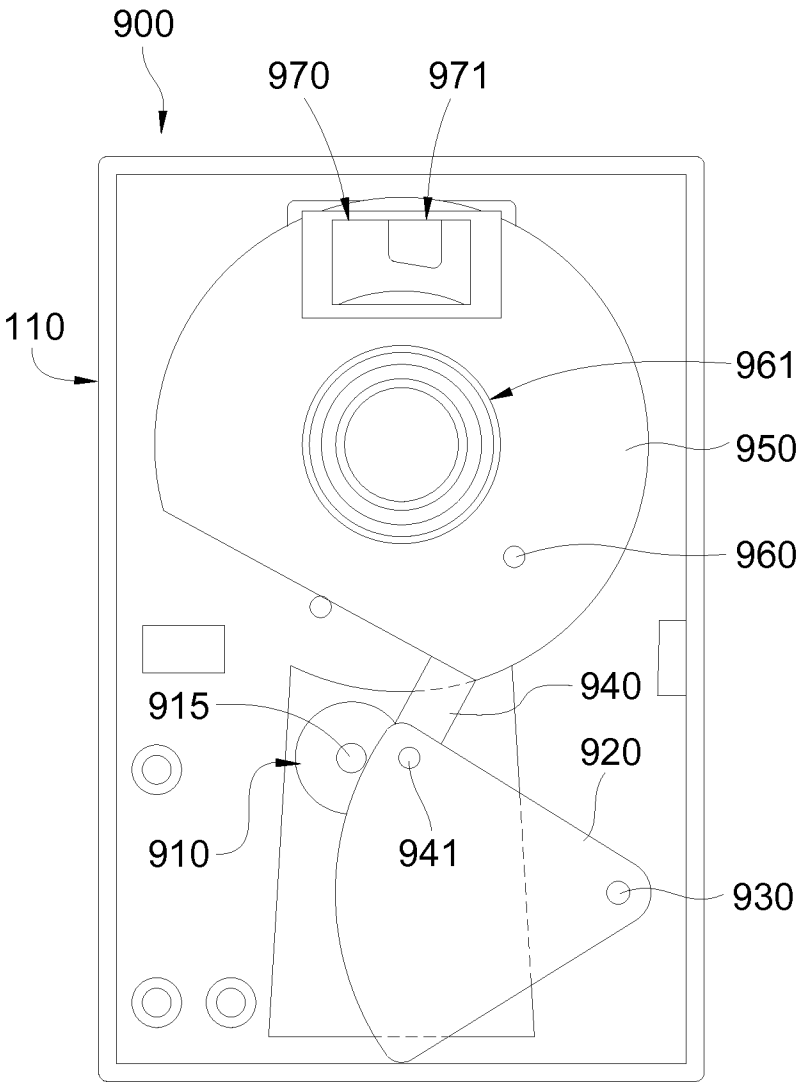

In certain embodiments, a medication release mechanism is disclose and shown in FIGS. 12A-12B. The medication release mechanism 900 may comprise a motor 910 that may comprise a pinion gear 915 and a segment gear 920 that pivots on pin 930. The segment gear 920 may connect to slave link 940 with a pin 941 in a four-bar linkage configuration with slave link 940 connected to rotating shutter 950 with pin 960, where the slave link 940 in turn may rotate a rotating shutter 950 around a cylindrical boss 961. The segment gear 920 and slave link 940 may rotate to a position as shown in FIG. 12A to align an opening 970 in the rotating shutter 950 with a dispensing opening 971 in the bottom of bottom cover plate 540 attached to the bottom of canister housing 110 to permit one or more doses of medication to be selectively dispensed from the locking canister. To lock the canister, the motor 910 may rotate in the opposite direction, rotating the segment gear 920, pulling the slave link 940 upwards as shown in FIG. 12B into an "over-center" position, and rotating the rotating shutter 950 back in front of the dispensing opening. In certain embodiments, if someone were to try to pry the rotating shutter 950 open, the "over-center" position of the slave link would prevent rotation of the rotating shutter 950 and keep the medicine dispensing mechanism locked. The over-center position may be located past the point where the three pivot points 930, 941, and 960 are in line, to lock the mechanism in an "over-center" position.

Figure 13:
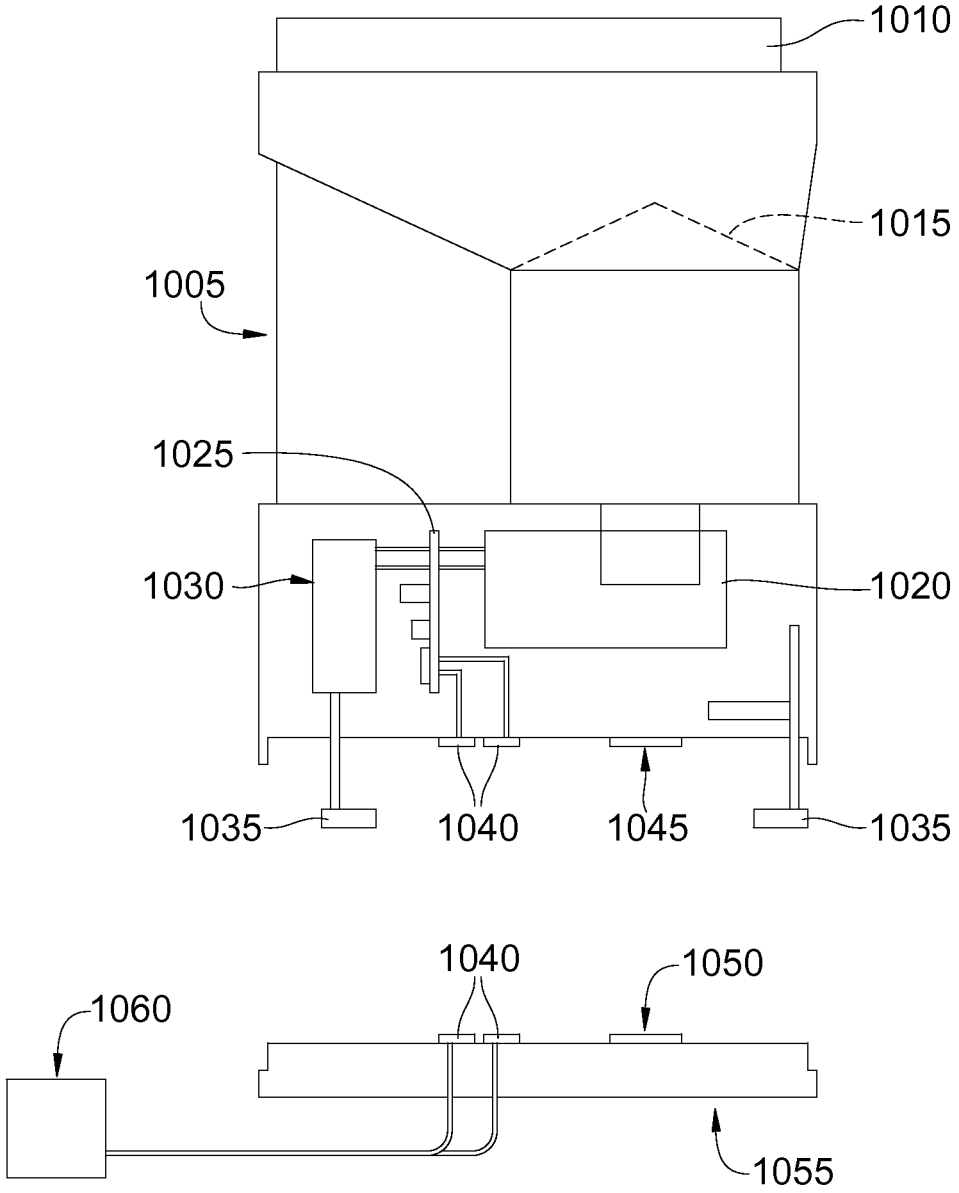
FIG. 13 depicts a locking canister and base station in accordance with certain embodiments.

In certain embodiments as shown in FIG. 13, a combined canister and base station may be employed to permit secure storage and dispensing of medication. A locking canister may comprise a canister housing 1005 and a canister cover 1010 for enclosing the canister housing 1005. The locking canister may comprise an index wheel 1015 for dispensing medication one dose at a time and may further comprise a motor 1020 for selectively rotating the index wheel 1015 to dispense one or more doses of medication. In certain embodiments, the canister may comprise a printed circuit board (PCB) 1025 for controlling the motor 1020 to selectively rotate the index wheel 1015. The PCB 1025 may also or alternately be used to control a locking/unlocking motor 1030 for actuating one or more cam locks 1035 for selectively locking the base station 1055 to the canister housing 1005 and unlocking the base station 1055 from the canister housing 1005. The canister housing 1005 may further include one or more contacts 1040 and an RFID tag 1045. The base station 1055 may include one or more contacts 1040 for communicating with the one or more contacts 1040 on the canister housing 1005 when the base station 1055 is attached to the canister housing 1005. The one or more contacts 1040 on the base station 1055 may be coupled to a processor 1060 for controlling the operation of the locking/unlocking motor 1030 and/or the motor 1020. The base station may comprise a RFID Sensor 1050 for reading RFID tag 1045. RFID tag 1045 may be programmed with information regarding the medication stored in the canister, including but not limited to the type and quantity of medication. The information stored in RFID tag 1045 can be updated as medication is loaded in or dispensed from the canister.

Figure 14B:
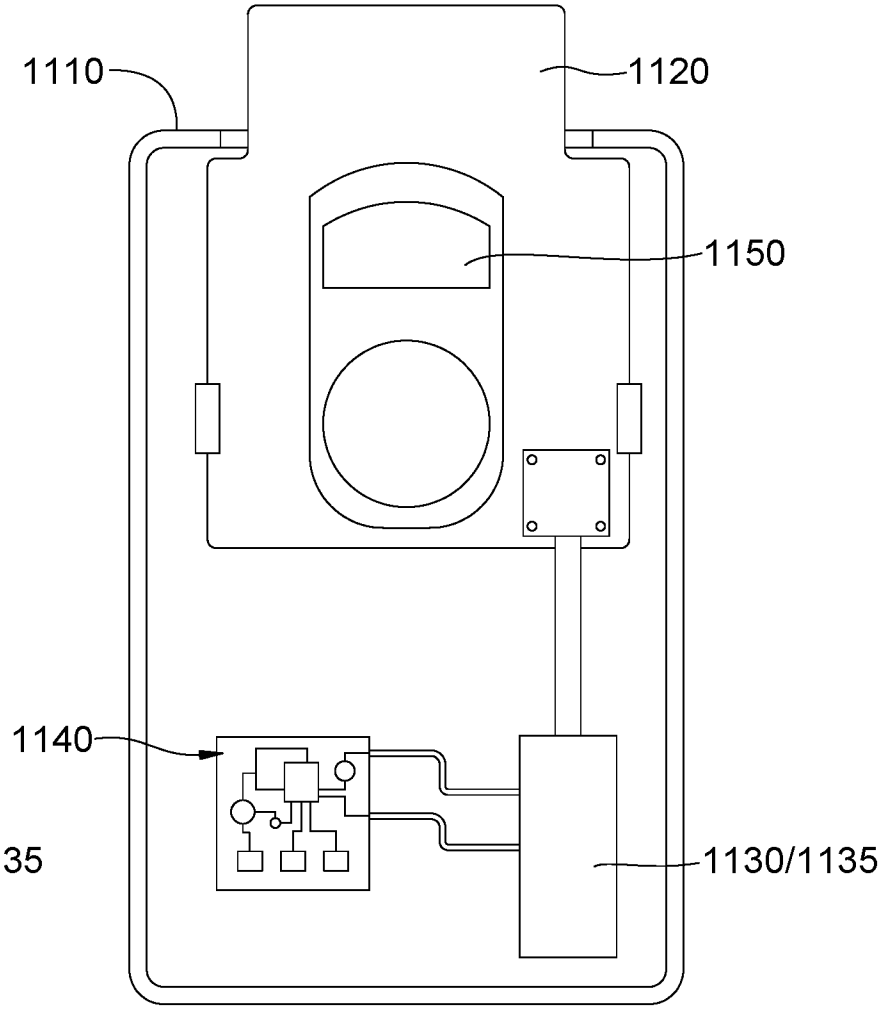
FIGS. 14A and 14B depicts a medication release mechanism in accordance with certain embodiments in accordance with certain embodiments.
Figure 14A:
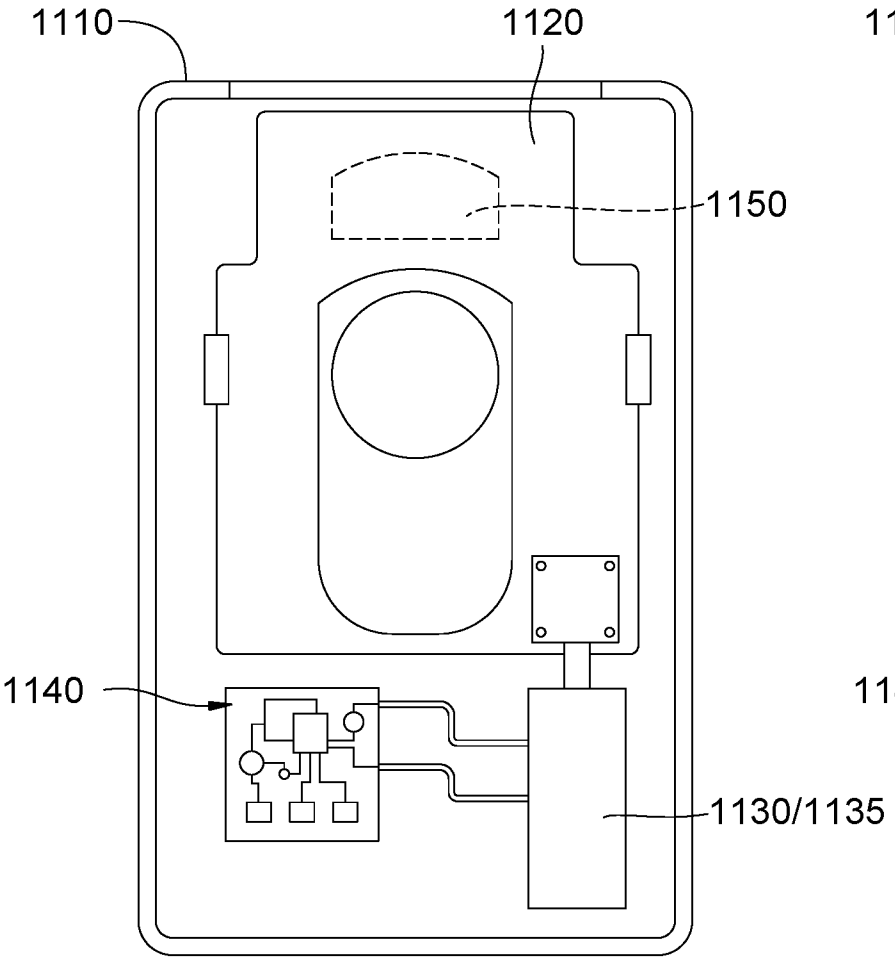

In certain embodiments, a canister housing 1110 may include a medication dispensing mechanism with a moveable element 1120 with a closed position as shown in FIG. 14A and a retracted position as shown in FIG. 14B. The canister housing 1110 may include a motor 1130 for selectively moving the moveable element 1120 from the closed position to the retracted position to permit one or more doses of medication to be dispensed via hole 1150 in the canister housing 1110. The canister may further comprise a PCB 1140 with circuitry for controlling motor 1130. In certain embodiments, a solenoid 1135 may be used in place of motor 1130. In certain embodiments, the moveable element 1120 may be driven by a worm gear and motor or a jack screw and motor instead of a solenoid (as pictured) to prevent tampering.

Figure 16:
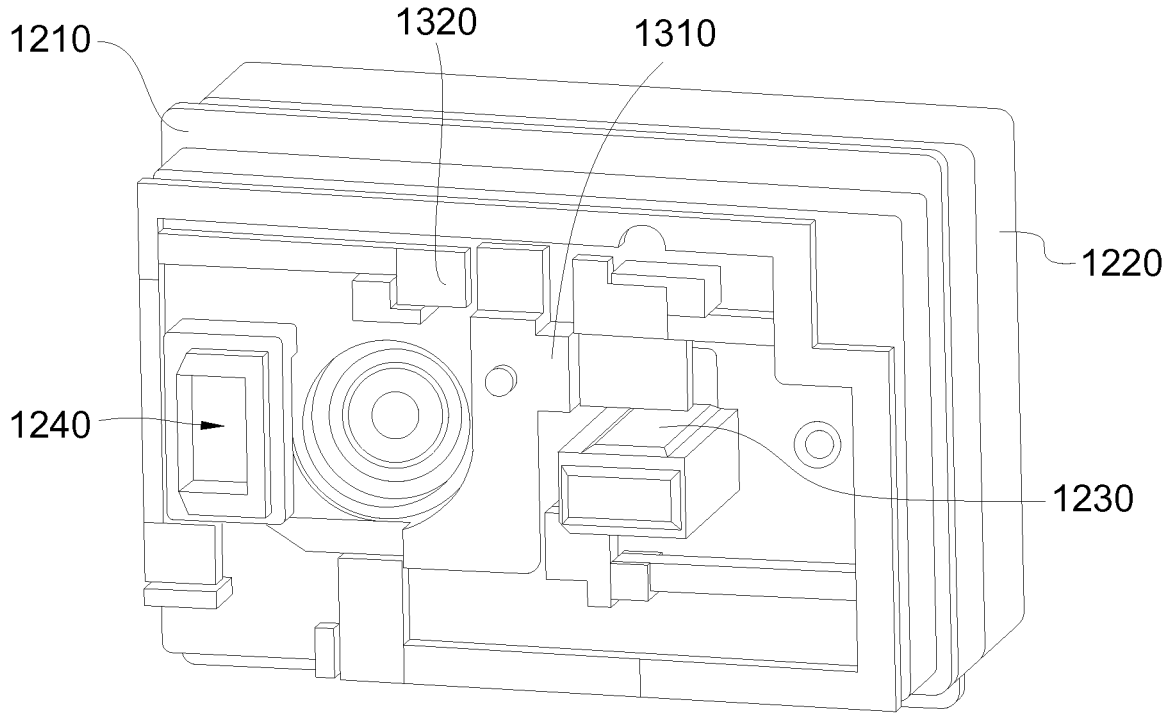
FIG. 16 depicts a cutaway view of the locking canister and base station of FIG. 15 in accordance with certain embodiments.
Figure 17:
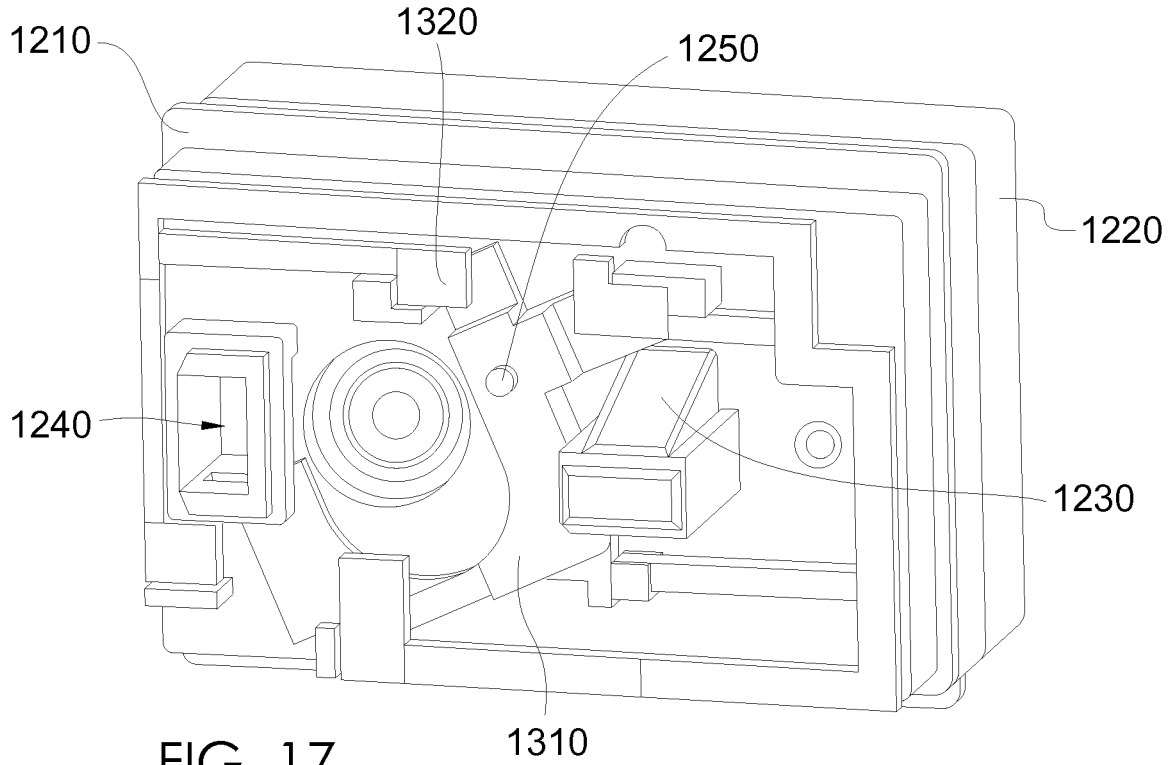
FIG. 17 depicts a cutaway view of the locking canister and base station of FIG. 15 in accordance with certain embodiments.

In certain embodiments as shown in FIGS. 15-17, canister housing 1210 may be used with a base station 1220 to provide a locking mechanism for a medication dispensing mechanism. The base station 1220 may include one or more raised elements 1250 for engaging corresponding retaining elements 1320 on the canister housing 1210. The canister housing may further include a pivoting or rotating shutter door 1310. The rotating shutter door 1310 may be driven by a rotating lever 1230 that may be biased in the extended position as shown in FIG. 15 with a biasing element, such as but not limited to a spring, that may be located inside a tower on top of the canister base station 1220. The rotating shutter door 1310 may be locked in a closed position as shown in FIG. 16 by one or more retaining elements 1320. When the canister housing 1210 is separated from base station 1220, the rotating shutter 1310 remains locked or may be returned to the locked position by a biasing element to prevent tampering with the canister in transit, for instance from a central pharmacy to a remote pharmacy. When the rotating shutter 1310 is in the locked position, it blocks dispensing hole 1240 to prevent dispensing medication from the canister. When the canister housing is attached to the base station, one or more raised elements 1250 may engage one or more retaining elements 1320 to move the retaining elements 1320 to a position where they no longer block rotating shutter 1310 from rotating from the closed position shown in FIG. 16 to the retracted position shown in FIG. 17 by the biasing element that pushes rotating lever 1230 to the extended position. Alternately, one or more raised elements 1250 may engage rotating shutter 1310 to move rotating element 1310 to a position where it is no longer blocked from rotating from the closed position shown in FIG. 16 to the retracted position shown in FIG. 17.

When the canister is assembled onto the base station 1220, the rotating lever 1230 may pivot into a retracted position tucked inside the tower by a force applied to rotating lever 1230 by rotating shutter 1310. Then, the raised elements 1250 sticking out of the base station as shown in FIG. 15 go into corresponding holes in a bottom cover plate on the bottom of the canister housing. The raised elements 1250 may push down the retaining elements 1320, allowing the spring-loaded rotating lever to push the rotating shutter 1310 from the closed position shown in FIG. 16 to the retracted position shown in FIG. 17 to expose dispensing hole 1240. When the canister is removed from the base station 1220, a biasing element may be used to rotate the rotating shutter 1310 back to the closed position shown in FIG. 16, and the retaining elements 1320 may be biased to return to the position shown in FIG. 16 where they lock rotating shutter 1310 in the closed position.

While the invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, operation or operations, to the objective, spirit, and scope of the invention. All such modifications are intended to be within the scope of the claims appended hereto. In particular, while the methods disclosed herein have been described with reference to particular operations performed in a particular order, it will be understood that these operations may be combined, sub-divided, or re-ordered to form an equivalent method without departing from the teachings of the invention. Accordingly, unless specifically indicated herein, the order and grouping of the operations is not a limitation of the invention.

We claim:

1. A locking canister for dispensing pharmaceuticals, comprising:

a canister housing comprising an outer portion, an inner portion and one or more lock features, wherein the one or more lock features comprises a first recess in a first side of the inner portion and a second recess in a second side of the inner portion opposite the first side;

a canister cover for locking to the canister housing to enclose the inner portion;

one or more cover locking mechanisms attached to the canister cover for selectively engaging one or more of the lock features;

wherein each of the one or more cover locking mechanisms is not visible when the canister cover is locked to the canister housing and wherein the one or more cover locking mechanisms comprise a first locking mechanism comprising a first locking tab for engaging the first recess and a second locking mechanism comprising a second locking tab for engaging the second recess; and a medication release mechanism for selectively releasing one or more doses of medication from the canister;

wherein each of the one or more cover locking mechanisms comprises:

a pivoting locking element pivotably attached to the canister cover, the pivoting locking element comprising:

a magnetic portion to move the locking element to an unlocked position; and a locking tab for engaging one of the lock features to lock the canister cover to the canister housing when the pivoting locking element is in a locked position;

wherein the locking tab for each of the one or more locking mechanisms is not accessible when the canister cover is locked to the canister housing; and wherein the canister is configured to be unlocked by placing the canister housing and canister cover into a cover removal fixture, the cover removal fixture comprising a first magnet for engaging a first magnetic portion of the first locking mechanism to unlock the first locking mechanism and a second magnet for engaging a second magnetic portion of the second locking mechanism to unlock the second locking mechanism.

2. The canister of claim 1, wherein the one or more lock features comprises one or more of a fixed tab, a strike plate, a rib, and a recess.

3. The canister of claim 1, wherein the medication release mechanism comprises a retractable portion, the retractable portion having a closed position and a retracted position and configured to be selectively moved from the closed position to the retracted position to dispense one or more doses of medication from the canister.

4. The canister of claim 3, wherein the retractable portion comprises a rotating shutter.

5. The canister of claim 3, further comprising a medication locking mechanism for locking the retractable portion in at least one of the closed and the retracted position.

6. The canister of claim 5, wherein the medication locking mechanism comprises a worm gear for selectively rotating the retractable portion between the closed position and the retracted position.

7. The canister of claim 5, wherein the medication locking mechanism comprises a worm gear for selectively locking the retractable portion in at least one of the closed position and the retracted position.

8. The canister of claim 5, wherein the medication locking mechanism comprises a rotating portion for locking the retractable portion in the closed position when rotated to an over center position.

9. The canister of claim 1, further comprising:

a canister printed circuit board;

a motor; and a base unit for selectively connecting to a bottom surface of the canister, the base unit comprising:

a main PCB, which connects the motor to the canister printed circuit board for operating the medication release mechanism when the base unit is connected to the canister and for preventing dispensing of medications when the base unit is not attached to the canister.

10. The canister of claim 5, further comprising a motor for moving the retractable portion between the closed and the retracted positions.

11. The canister of claim 5, further comprising a solenoid for moving the retractable portion between the closed and the retracted positions.

12. The canister of claim 1, wherein the medication release mechanism comprises an index wheel for dispensing medication one dose at a time.

13. The canister of claim 1, further comprising a retaining member to prevent unauthorized movement of the index wheel.

14. A method of locking a canister to retain pharmaceuticals therein, comprising:

providing a canister housing comprising an outer portion, an inner portion and a plurality of lock features, wherein the plurality of lock features comprises a first recess in a first side of the inner portion and a second recess in a second side of the inner portion opposite the first side;

providing a canister cover comprising a plurality of cover locking mechanisms for locking the canister cover to the canister housing to enclose the inner portion, wherein each of the plurality of cover locking mechanisms is not visible when the canister cover is locked to the canister housing;

wherein the one or more cover locking mechanisms comprises a first locking mechanism comprising a first locking tab for engaging the first recess and a second locking mechanism comprising a second locking tab for engaging the second recess; and wherein locking the canister cover to the canister housing comprises engaging the first locking tab of the first cover locking mechanism in the first recess and engaging the second locking tab of the second cover locking mechanism in the second recess; and wherein unlocking the canister cover from the canister cover requires placing the canister housing and canister cover into a cover removal fixture comprising a first magnet and a second magnet, such that the first magnet engages a first magnetic portion of the first locking mechanism to unlock the first locking mechanism and the second magnet engages a second magnetic portion of the second locking mechanism to unlock the second locking mechanism;

providing a medication locking mechanism to prevent any unauthorized dispensing of medications;

inserting one or more doses of medication into the inner portion;

locking the canister cover to the canister housing;

unlocking the medication locking mechanism;

dispensing one or more of the one or more doses of medication from the canister.

15. The method of claim 14, wherein each of the plurality of cover locking mechanisms comprises:

a pivoting locking element pivotably attached to the canister cover, the pivoting locking element comprising:

a magnetic portion to move the locking element to an unlocked position; and wherein the step of locking comprises engaging at least one of the lock features with a locking tab to lock the canister cover to the canister housing.

16. The method of claim 15, wherein the plurality of lock features comprises one or more of a fixed tab, a strike plate, a rib, and a recess.

17. The method of claim 14, wherein the locking tab for each of the plurality of cover locking mechanisms is not accessible when the canister cover is locked to the canister housing.

18. The method of claim 15, further comprising biasing the pivoting locking element in the locked position.

19. The method of claim 18, wherein the step of biasing is accomplished at least in part by a selected one of a leaf spring, a compression spring, a torsion spring, and a molded-in-plastic spring.

20. The method of claim 14, wherein the canister cover further comprises one or more fixed locking tabs and wherein the step of locking further comprises engaging the one or more fixed locking tabs in a corresponding one or more recesses in the canister housing.

21. The method of claim 14, wherein the canister housing comprises a retractable portion, the retractable portion having a closed position and a retracted position.

22. The method of claim 21, further comprising locking the retractable portion in the at least one of the closed and the retracted position.

23. The method of claim 22, further comprising moving the retractable portion to the retracted position to selectively dispense one or more doses of medication.

24. The method of claim 21, wherein the step of selectively dispensing comprises moving the retractable portion from the closed position to the retracted position to dispense one or more doses of medication from the canister.

25. The method of claim 24, wherein the retractable portion comprises a rotating shutter.

26. The method of claim 24, further comprising locking the retractable portion in at least one of the closed and the retracted position.

27. The method of claim 26, wherein the step of locking the retractable portion is performed at least in part by a worm gear.

28. The method of claim 24, wherein the step of locking the retractable portion comprises rotating a rotating portion to an over center position.

29. The method of claim 14, wherein the canister housing further comprises a canister printed circuit board; and a motor; and further comprising providing a base unit for selectively connecting to the canister, the base unit comprising a main PCB; and connecting the base unit to the canister housing.

30. The method of claim 14, wherein the step of selectively dispensing one or more doses of medication from the canister can only be performed when the base unit is connected to the canister.

31. The method of claim 24, wherein the step of moving the retractable portion is performed at least in part by a motor.

32. The method of claim 26, wherein the step of moving the retractable portion is performed at least in part by a solenoid.

33. The method of claim 26, wherein the step of selectively dispensing comprises rotating an index wheel to dispense medication one dose at a time.

34. The method of claim 33, wherein the canister further comprises a retaining member to prevent unauthorized movement of the index wheel.

* * * * *